US005153026A

United States Patent [19]

Reed et al.

[11] Patent Number: 5,153,026

[45] Date of Patent: Oct. 6, 1992

[54] METHOD AND COMPOSITION FOR CHIP SEALING A ROADWAY

[76] Inventors: Wendell Reed, P.O. Box 3191, Modesto, Calif. 95393; Jeffrey Reed, P.O. Box 1620, Sacramento, Calif. 95691

[21] Appl. No.: 740,124

[22] Filed: Aug. 5, 1991

Related U.S. Application Data

[62] Division of Ser. No. 322,083, Mar. 10, 1989, Pat. No. 5,079,095.

[51] Int. Cl.[5] ..... B05D 5/10; E01C 5/12

[52] U.S. Cl. ..... 427/138; 106/277; 252/88; 252/311.5; 427/203; 427/308

[58] Field of Search ..... 404/19, 36; 427/136, 427/138, 368, 203; 428/489; 108/277; 252/88, 311.5

[56] References Cited

U.S. PATENT DOCUMENTS

| | | | |
|---|---|---|---|
| 3,513,005 | 5/1970 | Bradshaw et al. | 106/277 |
| 4,169,170 | 9/1979 | Doeksen | 427/155 |
| 4,222,916 | 9/1980 | Hergenrother | 427/385.5 X |
| 4,666,522 | 5/1987 | Hollis et al. | 106/277 X |

*Primary Examiner*—Michael Lusignan
*Attorney, Agent, or Firm*—Bielen, Peterson & Lampe

[57] ABSTRACT

A method and composition for chip sealing a roadway utilizing a coating containing a parent binding material. Stone chips are then spread onto the parent binding material to form a composite having an upper surface. A liquid composition is then applied over the upper surface of the composite. The liquid composition includes an emulsion of liquid asphalt, a lignosulfonic acid salt, and water.

12 Claims, 1 Drawing Sheet

METHOD AND COMPOSITION FOR CHIP SEALING A ROADWAY

This is a division of application Ser. No. 07/322,083 filed Mar. 10, 1989, now U.S. Pat. No. 5,079,095.

CROSS-REFERENCE TO RELATED APPLICATIONS

This application is related to co-pending applications Ser. No. 271,574, filed Nov. 15, 1988, now abandoned, and Ser. No. 177,156, filed Apr. 4, 1988, now abandoned.

BACKGROUND OF THE INVENTION

The present invention relates to a novel method and composition used to chip seal a roadway.

Highways and roadways are usually paved with an asphalt matt. Such asphalt matt, may be a new base or a base several years old. To extend the life of such asphalt matts, a chip sealing process has been extensively employed. This method normally entails placement of a relatively thin asphalt parent binding material atop the asphalt matt. Stone chips of high durability and high fracture plane characteristics are then spread atop the asphaltic parent binding material. These chips are also washed and screened to a certain size, which renders the chips as a very expensive component of the "chip seal" process. For example, the asphaltic parent binding material may be approximately 3/16 inch thick and the stone chips may be sized to approximately ⅜ of an inch. Ideally, half of each chip would extend above the parent binding material. Unfortunately, chips tend to stack one on top of another, pack too closely in a lateral direction, or do not adhere to the binding material for other reasons. Consequently, vehicular traffic tends to free stone chips from the parent material causing damage to vehicular windshields and bodies.

Prior art solutions to this problem have been to increase the amount of parent binding material, however this markedly reduces the skid resistance of the surface of the roadway and also increases the expense of the "chip seal" process. Excessive asphaltic binding material also tends to produce "bleeding", a seepage of slippery asphaltic material which may produce a dangerous road condition. Repeated sweeping or brooming has also been employed after application of the stone chips. Unfortunately, even such extensive sweeping merely rolls loose chips from one of its flat surfaces to another flat surface. Experience has shown that loose chips still exist after such extensive brooming.

Preventing chip loss during the "chip seal" process on a roadway would be a great advance in the transportation field.

SUMMARY OF THE INVENTION

In accordance with the present invention a novel and useful method and composition for chip sealing a roadway is provided.

The method associated with the present invention utilizes the step of coating the roadway with a parent binding material such as asphalt, asphaltic emulsion, rubber latexed asphaltic emulsion, and the like. Such coating may be spread to the same degree as the prior art or, importantly, to a lesser degree. In the case of an emulsion, the subsequent steps begin before such emulsion breaks, normally accompanied by a color change of the emulsion. Stone chips are then spread atop the parent binding material coating. The chips are sized to embed in the parent binding material to an extent of about half the overall dimension of the chip. The stone chips and the parent binding material form a composite that has a "salt-and-pepper" appearance. At this point, a single sweep or brooming of the surface may take place.

A liquid composition comprising an emulsion of a liquid asphalt, a lignosulfonic acid salt, and water, is applied to the composite. The emulsion captures the stone chips and seals the parent binding material to prevent bleeding at high ambient temperatures.

Thus, many of the problems associated with the prior art method and composition have been solved by the present invention.

It may be apparent that a novel and useful method and composition has been summarized and will be described in greater detail hereinafter.

It is therefore an object of the present invention to provide a method of chip sealing a roadway which substantially reduces the effort attributed to sweeping or brooming.

Another object of the present invention is to provide a method and composition usable for chip sealing a roadway which virtually eliminates vehicular windshield breakage in the aftermath of such chip sealing process.

A further object of the present invention is to provide a method and composition for chip sealing a roadway which reduces the overall cost of such a process.

A further object of the present invention is to provide a method and composition for chip sealing a roadway which reduces traffic closure time of the roadway while the process being performed.

Yet another object of the present invention is to provide a method and composition for chip sealing a roadway which does not induce "bleeding" of asphaltic components, like other overseals and, thus, greatly reduces potentially hazardous road surface conditions.

Another object of the present invention is to provide a method and composition for chip sealing a roadway which is durable and maintains the fixation of chips on the roadway over a long period of time.

The invention possesses other objects and advantages especially as concerns particular characteristics and features thereof will become apparent as the specification continues.

Figure 1:
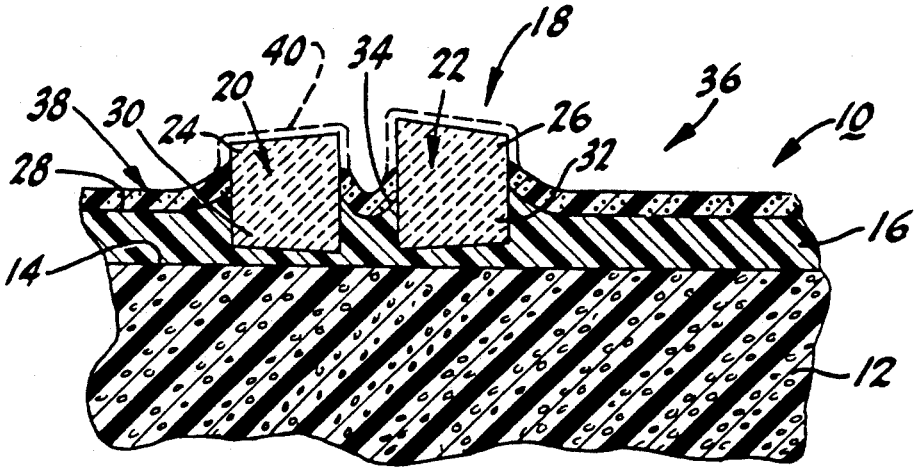
FIG. 1 is a sectional view of items utilized in the roadway chip sealing process of the present invention in place on such roadway

For a better understanding of the invention reference is made to the following detailed description of the preferred embodiments thereof which should be referenced to the hereinabove described drawings.

DESCRIPTION OF THE PREFERRED EMBODIMENTS

The composition as a whole is represented in the drawings by reference character 10. Emulsion 10, the components of which will be discussed in detail hereafter, is used in conjunction with a base or matt 12 having an upper surface 14. Matt 12 may be a new asphaltic base employing native aggregate which has been rolled, watered, and compacted. Also, matt 12 may be a aspalt course that has been worn by vehicular traffic and requires renewal or renovation. An asphaltic parent binding material 16 is normally spread atop surface 14 of base 12. For example, parent binding material 16 may take the form of a cationic asphaltic emulsion e.g. CRS-2, MC-800, LMCRS-2, or the like. The latter emulsion, LMCRS-2 consists of a latex modified asphaltic emulsion. Parent binding material 16 may be spread to a thickness of about ⅛ to 3/16 of an inch and in an amount of 0.3 gallons per square yard.

The prior art "chip sealing" process employs parent binding material 16 and a plurality of stone chips 18, represented by chips 20 and 22 in FIG. 1. Plurality of chips 18 are typically native aggregate rock which have been screened or sieved to a certain size. For example, plurality of chips 18 may be screened to a size of ⅜ inch (−). Plurality of chips 18 are usually obtained from a local source, are of high durability, and are fractured to a high degree, e.g. 90% fracture. Plurality of chips 18 are also washed and cleaned and are relatively expensive to obtain. Plurality of chips 18 are spread onto parent binding material 16 while the same is soft, to embed chips 18 within the parent binding material 16, depicted on FIG. 1. As may be apparent from FIG. 1, chips 20 and 22 include an upper portion 24 and 26, respectively, which extend upwardly and freely from upper surface 28 of parent binding material 16. Also, lower portions 30 and 32 of stone chips 20 and 22, respectively, extend into parent binding material 16 to the vicinity of surface 14 of base course 12. It should be noted that plurality of chips 18, as depicted in the drawings, are anionic for the sake of compatibility with cationic parent binding material 16. Such electrochemical relationship may be reversed in different geographical regions. For example, a meniscus 34 develops between parent binding material 16 and chip 24 as a result of this, heretofore described, cationic-anionic relationship.

The parent binding material 16 and plurality of chips 18 form a composite 36 which is then rolled, e.g. with a pneumatic rubber tire roller. Composite 36 represents a combination heretofore known and described in the prior art. Composite 36, however, has been found to be imperfect in that plurality of chips 18, although appearing to be firmly fixed and embedded within parent binding material 16 may be loosely held therein. Vehicular traffic tends to further loosen and separate a portion of plurality of chips 18, resulting in windshield breakage and dented vehicle bodies which can be a very dangerous situation to motorists and pedestrians. In addition, compensation paid to vehicle owner for broken windshields and damaged vehicle bodies is quite expensive, estimated to run approximately $1000.00(U.S.) per lane mile of a roadway. Also, chip loss under vehicle traffic substantially undermines the integrity of the "chip sealing" process and constitutes a substantial monetary loss attributable to stone chips removed from composite 36.

Prior art solutions have included multiple sweepings or broomings of the composite 36. Unfortunately, such brooming delays the resumption of traffic on the roadway subject to the "chip sealing" process and, in many cases, merely repositions a portion of plurality of chips 18 on different stone chip surfaces. In other words, a particular stone chip may be flipped without truly being embedded within parent binding material 16. Such stone chips 18 are particularly subject to release by vehicular traffic.

Another prior art solution requires the pouring of a thin layer of asphaltic material atop the parent binding material 16 e.g. SS-1 (as low setting anionic emulsion) and the like, in an attempt to further affix stone chips 18 to parent binding material 16. Unfortunately, such application although aiding in the retention of plurality of chips 18, hinders the usage of the roadway for 2–24 hours since "tracking" of road materials occurs during this initial period. In addition, "bleeding is induced when the surface temperature exceeds 130° F. Bleeding entails the exuding of liquid asphalt from parent binding material onto surface 28, creating a very slippery and hazardous condition to vehicles traveling on surface 28. Moreover, simply diluting the SS-1 with water reduces the chip holding characteristics of the SS-1. Finally, the application of this asphalt layer is also relatively expensive.

The method of the present invention includes coating the roadway with parent binding material 16 and spreading stone chips 18 onto the parent binding material to form composite 36. In addition, liquid composition 38, FIG. 1 is also applied to surface 28 and atop plurality of stone chips 18. With reference to FIG. 1, it may be seen that a thin film 40 (phantom) coats the exposed portions 24 and 26 of stone chips 20 and 22, respectively. Such film either immediately travels down chips 20 and 22 into liquid composition 38, is normally non-existent, or is quickly washed away by the elements. In the first case, film 40 may penetrate parent binding material 16, to lock in chips 18.

Liquid composition 38 takes the form of an emulsion having the following composition:

| COMPONENT | VOLUME PERCENTAGE |
|---|---|
| Liquid Asphalt (Specific Gravity 0.89–0.99) | 10–50% |
| Liquid Solution of 50% lignosulfonic acid salt and 50% water, by weight (Specific Gravity 1.23–1.28 at 77° C.) | 60%–10% |
| Water | 30–40% |

The liquid asphalt component above identified may be in the form of an asphalt emulsion base cement having penetration of generally from 30–60 using a needle penetrometer at 77° F. The solution of the lignosulfonic acid salt or lignonsulfonate and water may be in the form of a product sold under the trademark Orzan A, S, G, or LS, by Crown Zellerbach Corporation, Chemical Products Division of Camas Washington. Liquid composition 38 is also available under the trademark, D.O.P.E.-30, manufactured by Morgan Emultech, Inc. of Redding California.

The liquid composition 38 may also be described as follows:

| COMPONENT | WEIGHT PERCENTAGE |
|---|---|
| Liquid Asphalt | 49–8% |
| Salt of Lignosulfonic Acid Solids | 6%–33% |
| Water | 45–59% |

Figure 2:
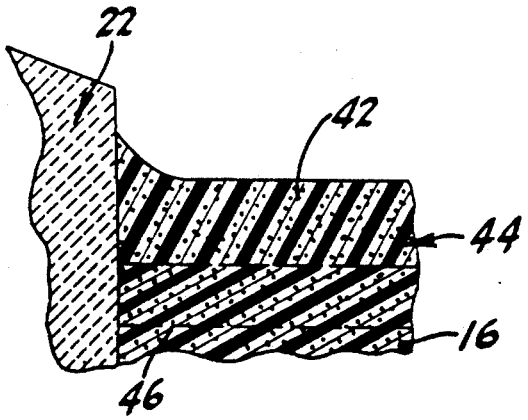
FIG. 2 is a sectional view of a portion of the components used in the chip sealing process of the present invention.

Liquid composition 38 seals parent binding material 16 and serves as a fixing agent for plurality of chips 18. Although composition 38 is initially heated to 120° F. to 150° F. and spread as a liquid, eventually, component 38 "breaks" into a believed asphaltic layer 42, with the lignosulfonic acid solution 44 dispersed into the asphalt layer 42 and, possibly, the parent binding material layer 16. Although the actual structure of the emulsion 38 in its "broken" state is not known, it is theorized that the lignosulfonic solution extends into the parent binding material 16 along an interface 46. The theorized structure is depicted in FIG. 2. It should also be noted that the film 40 shown in FIG. 1 is removed from chip 22 in FIG. 2 for the reasons above delineated. It is known, that emulsion 38 after setting or "breaking" successfully seals parent binding material 16 against "bleeding" and does not itself "bleed". It has been noted that no bleeding occurs at surface temperatures above 130° F. It has also been observed that plurality of chips 18 remain fixed in their embedded state within asphaltic layer 42 and parent binding material 16. The roadway treated with the chip sealing process of the present invention is available for usage after only 30 minutes from the application of emulsion 38. A single step of brooming prior to the application of emulsion 38 suffices to prevent loss of plurality of stone chips 18.

Emulsion 38 may be applied at a rate of 0.10 to 0.20 gallons per square yard. Preferably, emulsion 38 is applied at a rate of 0.12 to 0.17 gallons per square yard. Stone chips are normally layed down at a rate of 20 to 25 pounds per square yard. It should be noted that the parent binding material may be reduced to 0.25 gallons per square yard from the normal 0.30 gallons per square yard used in the prior art process hereinabove described.

Since the parent binding material has a specific gravity of 0.99 to 1.03, and the emulsion 38 possesses a specific gravity of 1.05 to 1.15, the following weight percentages apply to composition 10.

| ITEM | WEIGHT PERCENT |
|---|---|
| Stone Chips 18 | 88%-94% |
| Parent Binding Material 16 | 8%-3% |
| Emulsion 38 | 4%-3% |

The invention may be further understood by the following examples:

EXAMPLE I

An eight lane mile expanse of a high speed, high volume roadway was employed to test the characteristics of the composition of the present invention. The existing roadway asphalt matt was first coated with a parent binding material known as LMCRS-2, a cationic asphaltic product. The parent binding material was first laid down at a measured amount of about 0.3 gallons per square yard. This produced a layer of approximately ⅛" to 3/16" in thickness. Stone chips were next applied to the soft parent binding material at 22 to 23 lbs per square yard. The chips were high durability native aggregate, 90% fracture, 200 sieve with fines removed. The chips were approximately ⅜" in size and appeared to embed in the parent binding material. The parent binding material and embedded chip composite was then rolled (4) times with a pneumatic rubber tire roller. A single sweep was effected to remove loose chips after of the following emulsion (D.O.P.E. 30) was then placed atop the compacted composite:

1. approximately 24% by volume of liquid asphalt;
2. approximately 48% by volume of a solution of 50% by weight of a lignin sulfonic acid salt (lignosulfonate) and 50% by weight of water, known as Orzan; and
3. 28% by volume of water.

The same components by weight were determined to possess the weight percentages as follows:

23% liquid asphalt

26% lignin sulfonic acid salt solids, and

The emulsion was spread at 0.12-0.17 gallons per square yard. After (30) minutes the roadway was usable by traffic without loosening of the chips or emulsion ("tracking"). The finished roadway appeared black. After four months the subject expanse was reinspected. The roadway appeared to possess a "salt-and-pepper" surface with the chips firmly embedded in the asphalt component of the emulsion. No reported incidences of windshield breakage had occurred during this four month period. The subject roadway had maintained excellent traction in wet weather conditions since the composition of the present invention was placed on the subject roadway. Also, no "bleeding" of asphalt had taken place in ambient air temperatures of reaching about 100° F.

EXAMPLE II

A first short test section of a high speed, high volume roadway was prepared with the parent binding material and stone chips components, as in Example I. The composition was subsequently broomed one time. The composition of the present invention was then created by layering the emulsion (D.O.P.E. 30) atop the composite. A second short test section was prepared according to the prior art "chip sealing" method i.e.: only the parent binding material and stone chip composite, and was boomed four times. After an approximate six month period of vehicular use, the first and second test sections were inspected. The second prior art test section exhibited a substantial loss of chips and appeared grayer than the first test section which possessed a blacker appearance. A grayish hue generally indicates increased porosity, although no other confirming porosity tests were conducted. No bleeding of asphalt has occurred in the first test section in ambient air temperature of about 100%F.

EXAMPLE III

An existing roadway needing repair is coated with a parent binding material, LMCRS-2, a cationic asphaltic product. Such parent binding material is laid down at about 0.25 gallons per square yard. This amount results in a layer of about ⅛" in thickness. High durability, native aggregate, 90% fracture, 3/8 inch (−), stone chips are spread at 20-25 lbs per square yard to form a composite with the chips embedded in the parent binding material. A single sweeping of the upper surface of the composite after hardening is effected. An emulsion of 6%-33% Lignosulfonate solids, 49.0-7.0% asphalt and 45-60% water, by weight, is then spread over the composite at about 0.10-0.20 gallons per square yard. The breaking emulsion binds the stone chips in place, obviating further brooming.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A method of chip sealing a roadway comprising;
   a. coating the roadway with a parent binding material;

b. spreading stone chips onto the parent binding material to form a composite material with a surface; and c. applying a liquid composition comprising an emulsion of from 10%-50% by volume of a liquid asphalt, from 60%-10% by volume of a solution of 50% by weight of a lignosulfonic acid salt and 50% by weight of water, and from 30-40% by volume of water, to the surface and composite material.

2. The method of claim 1 which additionally comprises the step of brooming said surface of said composite material prior to said step of applying a liquid composition.

3. The method of claim 1 in which said step of applying a liquid composition further includes applying said emulsion at a rate of 0.10 to 0.20 gallon per square yard.

4. The method of claim 1 in which said step of applying a liquid composition to said surface of said composite material further includes applying said emulsion at a rate of 0.12 to 0.17 gallons per square yard.

5. The method of claim 1 which additionally comprise the step of compacting said composite material after said step of spreading stone chips.

6. The method of claim 5 which additionally comprises the step of brooming said surface of said composite after said step of compacting said composite.

7. A method of chip sealing a roadway comprising:

a. coating the roadway with a parent binding material;

b. spreading stone chips onto the parent binding material to form a composite material with a surface; and c. applying a liquid composition comprising an emulsion of from 49%-8%, by weight of a liquid asphalt, from 6%-33% by weight of a lignosulfonic acid salt and 45-59% by weight of water to said surface of said composite material.

8. The method of claim 7 which additionally comprises the step of brooming said surface of said composite prior to said step of applying a liquid composition to said surface of said composite material.

9. The method of claim 7 in which said step of applying a liquid composition further includes applying said emulsion at a rate of 0.10 to 0.20 gallons per square yard.

10. The method of claim 7 in which said step of applying a liquid composition further includes applying said emulsion at a rate of 0.12 to 0.17 gallons per square yard.

11. The method of claim 7 which additionally comprises the step of compacting said composite material after said step of spreading stone chips.

12. The method of claim 11 which additionally comprises the step of brooming said surface of said composite material after said step of compacting said composite.

* * * * *